US006997229B2

(12) United States Patent
Marschand et al.

(10) Patent No.: US 6,997,229 B2
(45) Date of Patent: Feb. 14, 2006

(54) ROTATABLE APPLICATOR TIP FOR A CORRECTIVE TAPE DISPENSER

(75) Inventors: Bret R. Marschand, Glendale Heights, IL (US); Andrew Bielecki, Evanston, IL (US)

(73) Assignee: Sanford, L.P., Freeport, IL (US)

( * ) Notice: Subject to any disclaimer, the term of this patent is extended or adjusted under 35 U.S.C. 154(b) by 335 days.

(21) Appl. No.: 10/663,074

(22) Filed: Sep. 16, 2003

(65) Prior Publication Data

US 2005/0056376 A1 Mar. 17, 2005

(51) Int. Cl.
*B32B 31/00* (2006.01)

(52) U.S. Cl. ..... 156/577; 156/523; 156/579; 118/76; 242/160.4; 242/171; 242/588.6

(58) Field of Classification Search ..... 156/523, 156/527, 538, 540, 574, 577; 118/76, 200, 118/257; 225/46; 242/160.2, 160.4, 170, 242/171, 588, 588.2, 588.3, 588.6; D19/67, D19/68, 69

See application file for complete search history.

(56) References Cited

U.S. PATENT DOCUMENTS

| | | | |
|---|---|---|---|
| 466,923 | A | 1/1892 | Price |
| 474,629 | A | 5/1892 | Coe |
| D178,713 | S | 9/1956 | Williams et al. |
| RE25,056 | E | 10/1961 | Fritzinger |
| 3,211,604 | A | 10/1965 | Rymer |
| 3,274,038 | A | 9/1966 | Kam |
| 3,339,797 | A | 9/1967 | Knutson |
| 3,399,100 | A | 8/1968 | Rothenberger |
| 3,509,000 | A | 4/1970 | Brown |
| 3,839,127 | A | 10/1974 | Hazuka et al. |
| 3,902,956 | A | 9/1975 | Thompson, Jr. |
| 3,969,181 | A | 7/1976 | Seabold |
| 4,086,121 | A | 4/1978 | Ames |
| 4,090,914 | A | 5/1978 | Hauk et al. |
| 4,151,039 | A | 4/1979 | Lash |
| 4,336,097 | A | 6/1982 | Van Kampen et al. |
| D280,738 | S | 9/1985 | Grassi |
| 4,574,030 | A | 3/1986 | Pilcher |
| 4,576,311 | A | 3/1986 | Horton et al. |

(Continued)

FOREIGN PATENT DOCUMENTS

| | | |
|---|---|---|
| CA | 2091996 | 2/1993 |

(Continued)

OTHER PUBLICATIONS

International Search Report dated Aug. 5, 2004—PCT/US2004/01132.

(Continued)

*Primary Examiner*—Mark A. Osele
(74) *Attorney, Agent, or Firm*—Marshall, Gerstein & Borun LLP

(57) ABSTRACT

A correction tape dispenser includes a housing with a pair of receiving holes. A carrier ribbon has a first end wound about a supply spool and a second end wound about a take-up spool. An applicator tip is at least partially disposed within the housing and includes a platform with a front edge, a rear edge, a first side edge, a second side edge, a top surface and a bottom surface. The carrier ribbon is disposed on the top surface, around the front edge, and on the bottom surface. The platform includes a slot that defines first and second legs. A first post extends laterally out from the first side edge, and a second post extends laterally out from the second side edge, the first post and the second post being rotatably disposed within the receiving holes of the housing.

17 Claims, 3 Drawing Sheets

U.S. PATENT DOCUMENTS

| | | | |
|---|---|---|---|
| 4,718,971 | A | 1/1988 | Summers |
| 4,849,064 | A | 7/1989 | Manusch et al. |
| 4,851,076 | A | 7/1989 | Manusch et al. |
| 4,853,074 | A | 8/1989 | Manusch |
| 4,891,090 | A | 1/1990 | Lorincz et al. |
| 4,997,512 | A | 3/1991 | Manusch |
| 5,006,184 | A | 4/1991 | Manusch et al. |
| D319,664 | S | 9/1991 | De Lucchi |
| 5,049,229 | A | 9/1991 | Czech |
| 5,125,589 | A | 6/1992 | Manusch |
| 5,281,298 | A | 1/1994 | Poisson et al. |
| 5,303,759 | A | 4/1994 | Czech |
| 5,310,437 | A | 5/1994 | Tucker |
| 5,310,445 | A | 5/1994 | Tucker |
| 5,316,613 | A | 5/1994 | Samuelson et al. |
| 5,346,580 | A | 9/1994 | Elges et al. |
| 5,379,477 | A | 1/1995 | Tamai et al. |
| 5,393,368 | A | 2/1995 | Stevens |
| 5,430,904 | A | 7/1995 | Ono et al. |
| 5,472,560 | A | 12/1995 | Horng |
| 5,490,898 | A | 2/1996 | Koyama |
| 5,556,469 | A | 9/1996 | Koyama et al. |
| 5,595,626 | A | 1/1997 | Yokouchi et al. |
| 5,679,156 | A | 10/1997 | Matsumaru |
| 5,685,944 | A | 11/1997 | Nose et al. |
| 5,714,035 | A | 2/1998 | Stevens |
| 5,759,270 | A | 6/1998 | Lee |
| 5,759,341 | A | 6/1998 | Kobayashi |
| 5,770,007 | A | 6/1998 | Czech et al. |
| 5,772,840 | A | 6/1998 | Morinaga |
| 5,785,437 | A | 7/1998 | Koyama et al. |
| 5,792,263 | A | 8/1998 | Koyama et al. |
| 5,795,085 | A | 8/1998 | Yoo |
| 5,820,728 | A | 10/1998 | Stevens et al. |
| D400,585 | S | 11/1998 | Fritz et al. |
| 5,899,619 | A | 5/1999 | O'Shei |
| 6,000,455 | A | 12/1999 | Semmler |
| 6,059,002 | A | 5/2000 | Katami |
| 6,062,286 | A | 5/2000 | Koyama et al. |
| 6,065,887 | A | 5/2000 | You |
| 6,105,650 | A | 8/2000 | Manusch et al. |
| 6,112,796 | A | 9/2000 | Stevens |
| 6,125,903 | A | 10/2000 | Uchida |
| 6,145,770 | A | 11/2000 | Manusch et al. |
| 6,171,397 | B1 | 1/2001 | Mitsuya |
| 6,227,274 | B1 | 5/2001 | Koyama et al. |
| 6,270,578 | B1 | 8/2001 | Murakoshi |
| 6,273,162 | B1 | 8/2001 | Ohara et al. |
| 6,273,169 | B1 | 8/2001 | Ono et al. |
| 6,273,982 | B1 | 8/2001 | Semmler |
| 6,321,815 | B1 | 11/2001 | You |
| 6,321,816 | B1 | 11/2001 | Koreska |
| 6,325,130 | B1 | 12/2001 | Kageyama et al. |
| 6,360,805 | B1 | 3/2002 | Takahashi |
| 6,363,990 | B1 | 4/2002 | Kozaki |
| 6,363,992 | B1 | 4/2002 | Semmler |
| 6,379,461 | B1 | 4/2002 | Masumoto |
| 6,418,997 | B1 | 7/2002 | Tamai et al. |
| 6,422,284 | B1 | 7/2002 | Kelders et al. |
| 6,435,248 | B1 | 8/2002 | Masumoto |
| 6,450,231 | B1 | 9/2002 | Ishikawa |
| 6,453,969 | B1 | 9/2002 | Ferrara |
| 6,500,259 | B1 | 9/2002 | Tamai et al. |
| 6,461,068 | B1 | 10/2002 | Holmes |
| 6,521,045 | B1 | 2/2003 | Koyama et al. |
| 6,729,377 | B1 | 4/2004 | Huthmacher |
| D491,986 | S | 7/2004 | Bain |
| 2002/0195205 | A1 | 12/2002 | Watanabe |
| 2003/0034133 | A1 | 2/2003 | Huthmacher |
| 2003/0062135 | A1 | 4/2003 | Takahashi |
| 2003/0066612 | A1 | 4/2003 | Bauersachs |

FOREIGN PATENT DOCUMENTS

| | | | |
|---|---|---|---|
| CA | 2094603 | | 3/1993 |
| DE | 3834374 | A1 | 4/1990 |
| EP | 0 267 396 | B2 | 9/1987 |
| EP | 0267396 | B2 | 9/1987 |
| EP | 0 551 522 | A1 | 7/1993 |
| EP | 0 551 522 | B1 | 7/1993 |
| EP | 0 556 406 | B1 | 8/1993 |
| EP | 1 114 786 | A | 7/2001 |
| EP | 1 332 998 | A | 8/2003 |
| FR | 2 643 351 | | 8/1990 |
| GB | 1 434 006 | | 4/1976 |
| JP | 2002 127683 | A | 5/2002 |

OTHER PUBLICATIONS

International Preliminary Examining Authority, Written Opinion (PCT Rule 43bis.1) in Application No. PCT/US2004/01132, dated Aug. 5, 2004.

International Search Report dated Aug. 2, 2004—PCT/US2004/008271.

International Preliminary Examining Authority, Written Opinion (PCT Rule 43bis.1) in Application No. PCT/US2004/008271, dated Aug. 2, 2004.

10
12
14
16
18
20
22
24
26
28
57
150
152
154
156
158
160
162
164
166

ROTATABLE APPLICATOR TIP FOR A CORRECTIVE TAPE DISPENSER

FIELD OF THE DISCLOSURE

The present disclosure relates to a transfer tape dispenser, and more particularly to a rotatable applicator tip for a corrective tape dispenser.

BACKGROUND OF THE DISCLOSURE

Correction tape dispensers can be used to cover mistakes made on a substrate, such as a sheet of paper, including writing or typing errors. In a common example, a correction tape dispenser includes a housing inside which a supply spool and a take-up spool are disposed. A carrier ribbon has a first end wound about the supply spool and a second end wound about a take-up spool. One side of the carrier ribbon is coated with a corrective coating that is used to cover a mistake on a substrate.

An applicator tip having a platform with a front edge is attached to the housing with the front edge being outside the housing. The applicator tip assists in the transfer of the corrective coating from the carrier ribbon to the paper.

The housing can be held in the hand during use. In passing from the supply spool to the take-up spool, the carrier ribbon is directed to the applicator tip, across the platform, around the front edge, and back to the take-up spool. The front edge of the applicator tip creates a sharp bend in the ribbon to assist in releasing the corrective coating from the ribbon. The front edge presses the carrier ribbon against the surface of a sheet of paper or other substrate in order to transfer the corrective coating from the carrier ribbon onto the paper so as to cover a mistake made thereon and to facilitate the correction of the mistake.

As the front edge is moved across the paper, carrier ribbon with a fresh corrective coating is drawn from the supply spool while the take-up spool is driven to wind up the carrier ribbon which has passed over the front edge and hence from which the corrective coating has been removed. Thus, a straight continuous strip of corrective coating is laid down on the paper surface until the forward movement of the applicator tip is stopped and the tip is lifted away from the paper.

Present designs allow the applicator tip to be flexible so as to permit the user to more easily maintain contact between the applicator tip and the substrate. The goal of these designs is to make it easier to maintain contact between the edge of the applicator tip and the paper across which it is being dragged, even though the relative orientation of tip to the substrate might not be steady or constant. Many of these designs use a reduced cross sectional thickness over a portion of the applicator tip to provide the flexibility. This necessarily creates a thin portion of the applicator tip which is subject to manufacturing flaws and or failure.

In another aspect of present applicator tip designs, tape guides extend perpendicularly from the platform of applicator tip. These tape guides attempt to maintain alignment of the carrier ribbon to the applicator tip and the edge while the dispenser is in use, and not allow the carrier ribbon to slip off the side of the platform.

The tape guides of the prior art applicator tips are generally disposed outside the housing. Because the majority of these designs include tape guides that extend perpendicularly from the edge, these tape guides cannot rotate or flex within the housing and still have a tight fit within the housing.

Figures 1, 2, 9:
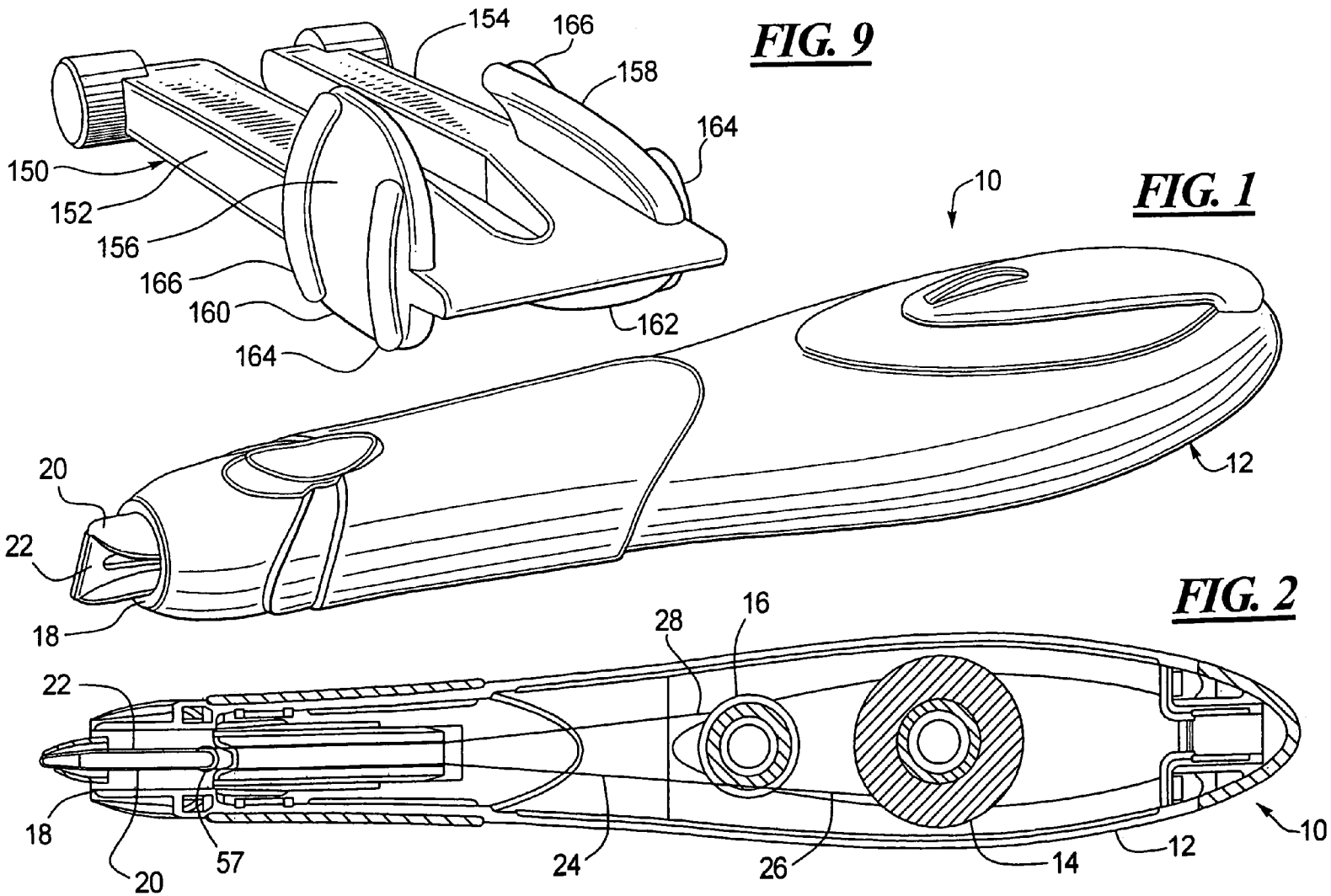
FIG. 1 is a perspective view of a corrective tape dispenser, constructed in accordance with the teachings of this disclosure.
FIG. 2 is a cross sectional view of the corrective tape dispenser of FIG. 1.
FIG. 9 is a perspective view of a fifth example of an applicator tip with rotation bearing surfaces on the tape guides.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and the equivalents falling within the spirit and scope of the invention as defined by the appended claims.

DETAILED DESCRIPTION

Referring now to the drawings, and in particular to FIGS. 1 and 2, a correction tape dispenser 10 is disclosed. While a correction tape dispenser 10 is disclosed herein, this is but one example of a transfer tape dispenser in which this technology can be used. Other transfer tape dispensers, including but not limited to adhesive tape dispensers, highlighter tape dispensers, and decorative tape dispensers, can also implement the teachings herein.

The dispenser 10 includes a housing 12 that can be sized to be held in one hand while the dispenser 10 is being used. A supply spool 14 and a take-up spool 16 are rotatably disposed within the housing 12. The housing 12 includes an opening 18 through which is disposed an applicator tip 20 with a platform 22.

A carrier ribbon 24 has a first end 26 connected to the supply spool 14 and a second end 28 connected to the take-up spool 16. The carrier ribbon 24 in the area of the first end 26 is generally wound about the supply spool 14 and in the area of the second end 28 is generally wound about the take-up spool 16. In transition between the supply spool 14 and the take-up spool 16, the carrier ribbon 24 is disposed over and around the applicator tip 20. The carrier ribbon 24 can be coated with a releasable corrective coating disposed on the side of the ribbon away from the platform 22 of the applicator tip 20. As is known in the art, a slip belt (not shown) can be provided around the supply spool 14 and the take-up spool 16 such that as the supply spool 14 is rotated, the slip belt is rotated and drives the take-up spool 16.

Figure 3:
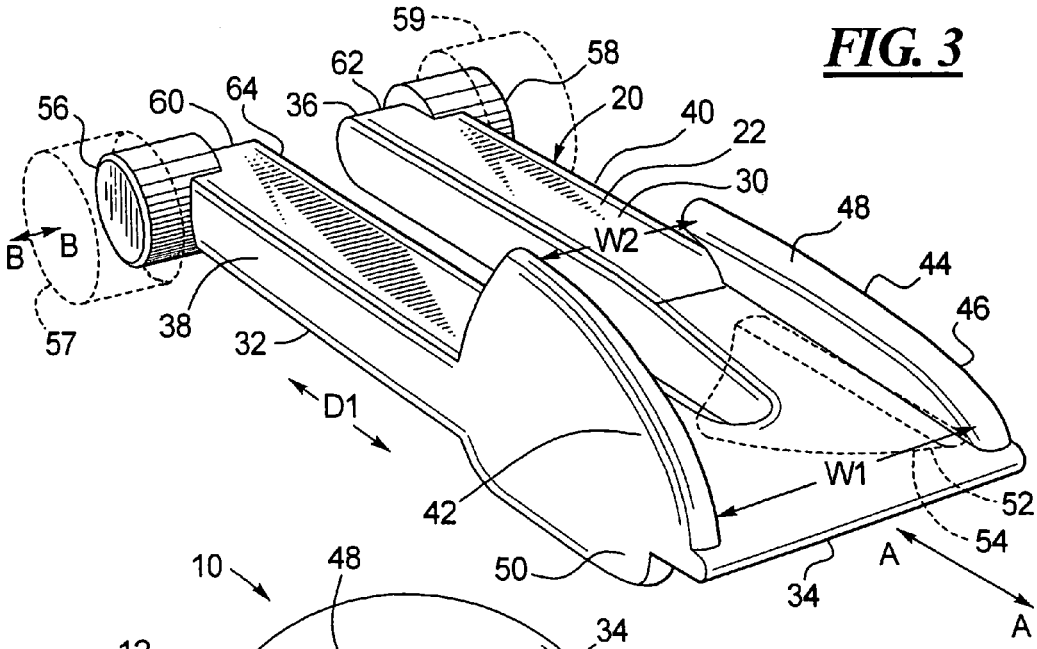
FIG. 3 is a perspective view of an applicator tip disposed within the housing.

Referring now to FIG. 3, the platform 22 of the applicator tip 20 extends in a direction D1 and includes a top surface 30, a bottom surface 32, a front edge 34, a rear edge 36, a first side edge 38 and a second side edge 40. The platform 22 can be substantially flat to allow the carrier ribbon 24 to slide easily thereover. The applicator tip 20 can be made from a flexible yet tough polymer such as polyethylene or polypropylene. Other suitable materials with these characteristics are known in the art.

Extending up from the top surface 30 of the platform 22, adjacent each of the side edges 38 and 40, respectively, and near the front edge 34, along part of the platform 22 in direction D1 is a first curved wall 42 and a second curved wall 44. The first curved wall 42 can be both tangential to a plane that is perpendicular to the platform 22 and intersects the first side edge 38. The second curved wall 44 can be both tangential to a plane that is perpendicular to the platform 22 and intersects the second side edge 40. The first curved wall 42 and the second curved wall 44 can curve over the platform 22 toward one another.

A third curved wall 50 and a fourth curved wall 52 extend adjacent each of the side edges 38 and 40, respectively, and near the front edge 34, out from the bottom surface 32 of the platform 22 and along part of the platform 22 in direction D1. The third curved wall 50 can be both tangential to a plane that is perpendicular to the platform 22 and intersects the first side edge 38, and the fourth curved wall 52 can be both tangential to a plane that is perpendicular to the platform 22 and intersects the second side edge 40. The third curved wall 50 and the fourth curved wall 52 can curve over the platform 22 toward one another.

The combination of the first curved wall 42, the second curved wall 44, the third curved wall 50, and the fourth curved wall 52 can form a portion of a cylinder 46. The first and second curved walls 42 and 44 can define a first slot 48 in the cylinder 46, and the third and fourth curved walls can define a second slot 54 in the cylinder 46. The first curved wall 42 and third curved wall 50 can define a continuous curved portion of the cylinder 46, and the second curved wall 44 and the fourth curved wall 52 can also define a continuous curved portion of the cylinder 46.

The first and second slots 48, 54 can be of varying widths along their length in the direction D1, and in this example, have a wider front width W1 closest to the front edge 34 than a rear width W2 nearest the rear edge 36. This can facilitate better viewing of the carrier ribbon 24 while the dispenser 10 is in use.

The curved walls 42, 44, 50, 52 help to retain the carrier ribbon 24 on the platform 22 and within the applicator tip 20 while the dispenser 10 is being used. If, during use, the carrier ribbon 24 slides toward one of the first or second side edges 38, 40, the carrier ribbon 24 cannot buckle up and slide over the curved walls 42, 44, 50, 52 due to their respective curvature.

As can be seen best in FIGS. 2 and 3, the first and second curved walls 42 and 44 extend virtually to the front edge 34 of the platform on the top surface 30, while the third and fourth curved walls 50, 52 are spaced back from the front edge 34 on the bottom surface 32. This ensures that the front edge 34 can press directly on the paper without interference from the third and fourth curved walls 50, 52. This further ensures that the first and second curved walls 42, 44 retain the used carrier ribbon 24 on the platform 22.

The applicator tip 20 can further include a first post 56 and a second post 58 extending laterally from the first and second side edges 38, 40 of the platform 22 near the rear edge 36 of the platform 22. The first post 56 can extend in a direction opposite from the second post 58.

The housing 12 can include a first receiver hole or depression 57 and a second receiver hole or depression 59, sized to receive the first post 56 and the second post 58, respectively. In FIG. 1, the receiver holes only partially extend through the walls of the housing 12 from the interior, and thus are not seen. First receiver hole 57 can be seen in FIG. 2, and both receiver holes 57 and 59 can be seen in phantom in FIG. 3. It may be decided, however, that the receiver holes 57 and 59 be through-holes and fully extend through the walls of the housing 12. The first and second posts 56, 58 within the first and second receiver holes 57 and 59 help to secure the applicator tip 20 within the housing 12. Further, the first post 56 and second post 58 can rotate within the first and second receiver holes, as will be detailed later herein. Finally, due to the flexibility that the applicator tip 20 can have, the applicator tip 20 can be removed from the housing 12 by pulling the posts 56 and 58 out from the receiver holes 57 and 59.

The applicator tip 20 can further include a first leg 60 and a second leg 62 defining a platform slot 64 therebetween. The platform slot 64 helps to impart a flexibility to the platform 22 to allow the platform 22 to flex and rotate within the housing 12, as will also be described herein. In this example, the platform slot 64 runs along the platform 22 in direction D1 from the rear edge 36 to an area of the platform 22 near the front edge 34.

Figure 4:
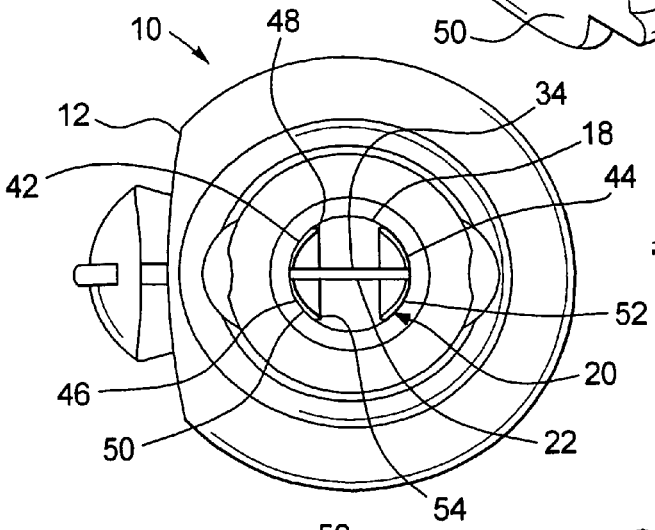
FIG. 4 is a view of the applicator tip within the housing taken along Line IV—IV.
Figure 5:
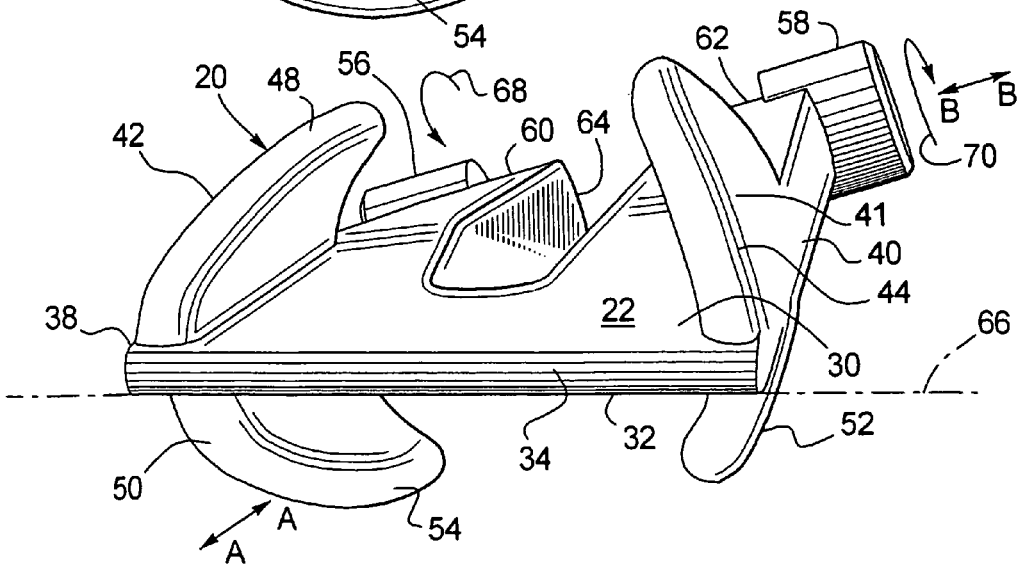
FIG. 5 is a perspective view of the applicator tip of FIG. 3 with the front edge in a flexed condition.

In use, a user may impart an unequal force along the front edge 34 by not properly aligning the edge 34 with a substrate surface, such as a piece of paper. If a portion of the front edge 34 was to be lifted from the paper during use, the corrective coating would not be transferred to the paper. To address this problem, as can be seen in FIGS. 4 and 5, the front edge 34 of the applicator tip 20 is flexibly rotatable about a length axis A—A relative to the housing 12. When unequal force is applied along the front edge 34, for example when the user twists the housing 12 while pressing the front edge 34 against the substrate 66, the platform 22 may rotatably and elastically flex to compensate for the twisting to ensure that the entire front edge 34 maintains contact with the paper 66 and that all corrective coating is released from the carrier ribbon 24 and disposed on the paper 66. The rotational flexibility of the platform 22 is due in part to the slot 64, as the first leg 60 can bend independent of the second leg 62, and in part to the elasticity of the material itself.

To further enhance the rotation of the front edge 34 about the length axis A—A, the first and second posts 56, 58 are rotatable within the first and second receiver holes about a post axis B—B. Because the platform 22 is slotted, the first post 56 can rotate independently of the second post 58, and when the front edge 34 is rotated, the first post 56 and second post 58 rotate in opposite directions as shown by first and second rotational indicators 68, 70. Thus, the disclosed tip construction creates a rotation about two separate axes. Furthermore, in this example, the entire top surface 30 and the entire bottom surface 32 of the platform 22 can flex to ensure that the carrier ribbon 24 does not leave the surfaces of the top surface 30 or bottom surface 32.

In this example, the curved walls 42, 44, 50, 52 can extend both partly inside and partly outside of the housing 12 and still allow the rotation of the applicator tip 20 relative to the housing 12. Since the curved walls 42, 44, 50, 52 can extend into the housing 12, the curved walls 42, 44, 50, 52 can extend a much further distance relative to the length of the tip platform surfaces and thereby more effectively retain the carrier ribbon 24 on the applicator tip 20.

Figure 6:
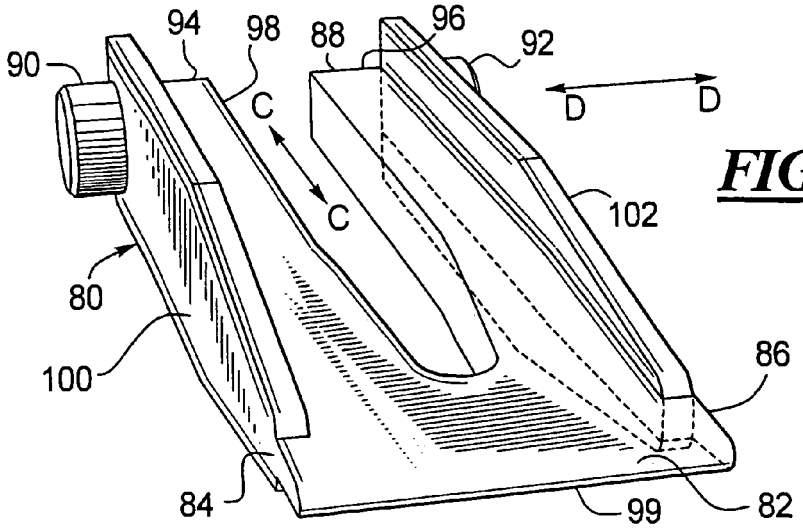
FIG. 6 is a perspective view of a second example of an applicator tip with a slotted platform and square tape guides.

A second example of an applicator tip 80 is disclosed in FIG. 6. In this example, the applicator tip 80 includes a platform 82 with first and second side edges 84, 86 and a back edge 88. First and second posts 90, 92 extend laterally outward in opposite direction from the first and second side edges 84, 86. The platform 82 includes a first leg 94 and a second leg 96 defining a slot 98 extending from a back edge 88 toward the front edge 99 along a direction D2. However, extending up from the platform 82 along the first and second side edges 84, 86 are first and second planar guide walls 100, 102. The first and second guide walls 100, 102 maintain a carrier ribbon within the applicator tip 80 and require simpler tooling to manufacture than the curved walls 42, 44, 50, 52 of the first example. This applicator tip 80 can be used as in the previous example including the platform 82 rotating about a length axis C—C, and the first and second posts 90, 92 rotating about a post axis D—D. This may be desirable in that the part and tooling could be less expensive than in the first example.

Figure 7:
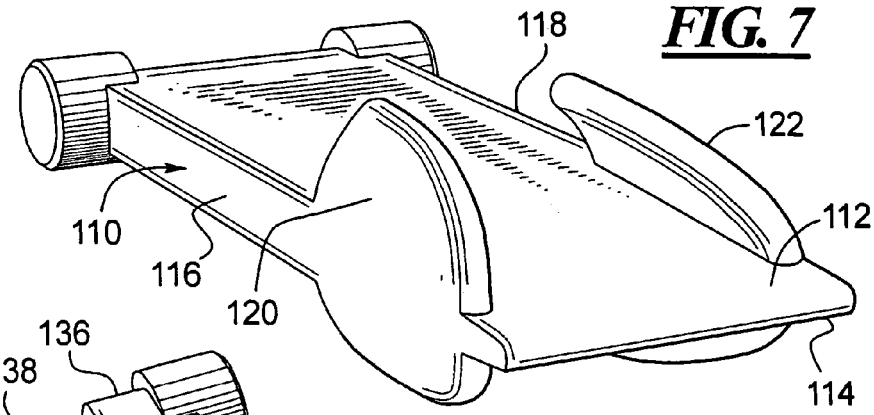
FIG. 7 is a perspective view of a third example of an applicator tip with rounded tape guides and an unslotted platform.

A third example of an applicator tip 110 is disclosed in FIG. 7. The applicator tip 110 includes a platform 112 with a front edge 114 and first and second side edges 116, 118. In this example, first and second curved walls 120, 122 are employed similar to the walls of the first example, but the platform 112 is integral or continuous, i.e., no slot is disposed in the platform 112. This example is useful if other means are employed for allowing the rotation of the front edge 114, or in applications in which little rotation is desired. This also may be desirable in that the part and tooling may be less expensive than in the first example.

Figure 8:
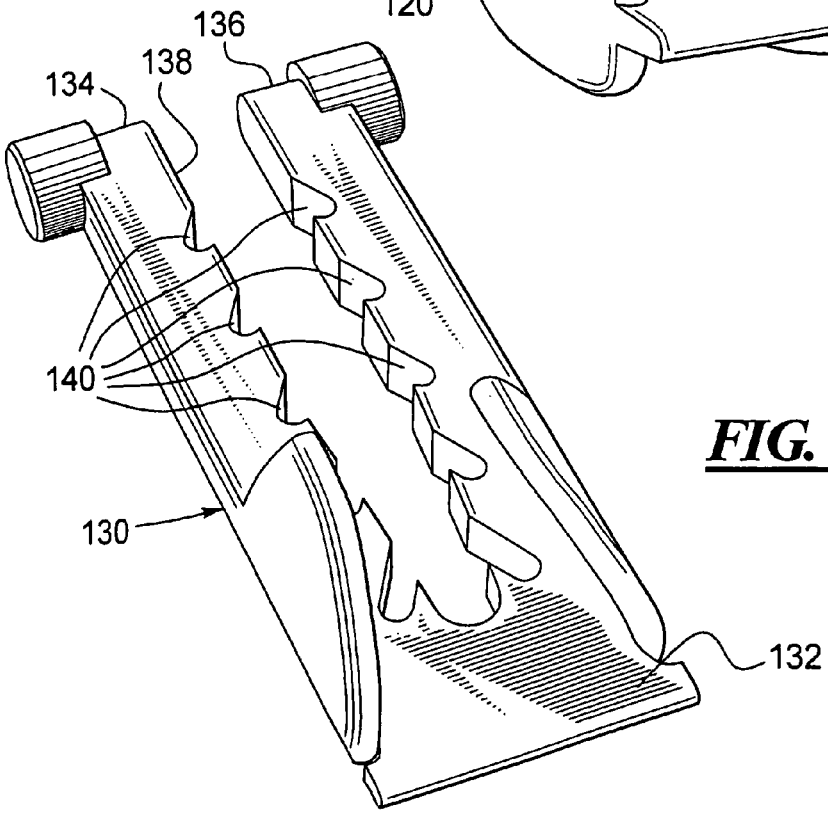
FIG. 8 is a perspective view of a fourth example of an applicator tip with notches within the slots of the platform.

A fourth example of an applicator tip 130 is disclosed in FIG. 8. The applicator tip 130 includes a platform 132 with a first leg 134 and a second leg 136 defining a slot 138 therebetween, as in the first example. However, in this example, the slot 138 includes several notches 140. The notches 140 can add to the flexibility of the platform 132 and allow a greater amount of rotation. Further, the specific configuration of the notches 140 or irregular slot wall can vary extensively.

FIG. 9 shows a view of a fifth example of an applicator tip 150 with first and second side edges 152, 154 and four curved walls 156, 158, 160, 162, as in the first example. The curved walls 156, 158, 160, 162, in this example, however, each include a first and second rotation bearing surface 164, 166. The bearing surfaces 164, 166 each extend radially outward from the curved walls 156, 158, 160, 162, and are adapted to bear against the inside of the housing. This ensures that the side edges 152, 154 of the applicator tip 150 do not contact the inside of the housing during rotation of the applicator tip 150 and help to ensure that the rotation is smooth.

From the foregoing, one of ordinary skill in the art will appreciate that the present disclosure sets forth a flexible applicator tip for corrective tape. However, one of ordinary skill in the art could readily apply the novel teachings of this disclosure to any number of applicators. As such, the teachings of this disclosure shall not be considered to be limited to the specific examples disclosed herein, but to include all applications within the spirit and scope of the invention.

We claim:

1. A elastically rotatable applicator tip adapted to be disposed in the housing of a correction tape dispenser, comprising:

a platform with a front edge, a rear edge, a first side edge, a second side edge, a top surface and a bottom surface and defining a length axis, wherein the top surface, bottom surface, and front edge are adapted to support a carrier ribbon;

a first wall extending up from the first side edge of the platform;

a second wall extending up from the second side edge of the platform;

wherein the platform includes a slot between the first and second side edges, the slot defining a first leg and a second leg in the platform;

a first post extending laterally out from the first side edge of the first leg and adapted to be rotatably positioned within a first receiver in the housing;

a second post extending laterally out from the second side edge of the second leg and adapted to be rotatably positioned within a second receiver in the housing; the first post and the second post defining a post axis; and wherein upon rotation of the front edge about the length axis, the first post and the second post are rotated within the first and second receiver, respectively, substantially about the post axis.

2. The applicator tip of claim 1, wherein the first wall is curved and the second wall is curved.

3. The applicator tip of claim 2, wherein the first curved wall and the second curved wall each include bearing surfaces extending out from the walls.

4. The applicator tip of claim 2, wherein the first curved wall and the second curved wall form a portion of a cylinder and define a cylinder slot therebetween.

5. The applicator tip of claim 4, wherein the cylinder slot is wider near the front edge than near the rear edge.

6. The applicator tip of claim 1, further comprising a third wall extending down from the first side edge and a fourth wall extending down from the second side edge.

7. The applicator tip of claim 6, wherein the first wall is a curved wall, the second wall is a curved wall, the third wall is a curved wall, and the fourth wall is a curved wall.

8. The applicator tip of claim 7, wherein the first curved wall, second curved wall, third curved wall, and fourth curved wall form portions of a cylinder.

9. The applicator tip of claim 8, wherein the first curved wall and the second curved wall define a slot in the cylinder.

10. The applicator tip of claim 6, wherein the first wall and the second wall are disposed nearer to the front edge than the third wall and the fourth wall.

11. The applicator tip of claim 1, wherein the first post and the second post rotate in opposite directions about the post axis when the front edge rotates about the length axis.

12. The applicator tip of claim 1, wherein the first leg and the second leg further include a plurality of notches.

13. The applicator tip of claim 1, wherein the first wall is planar and the second wall is planar.

14. A transfer tape dispenser, comprising:

a housing including a pair of receiving holes;

a supply spool disposed within the housing;

a take-up spool disposed within the housing;

a carrier ribbon with a first end and a second end, wherein the first end is connected to the supply spool, and the second end is connected to the take-up spool;

an applicator tip partially disposed within the housing and including a platform with a front edge, a rear edge, a first side edge, a second side edge, a top surface, a bottom surface;

a first wall extending up from a portion of the first side edge;

a second wall extending up from a portion of the second side edge;

wherein the carrier ribbon is disposed on the top surface, around the front edge, and the bottom surface between the first side edge and second side edge of the platform;

wherein the platform includes a slot defining a first leg and a second leg; and a first post extending laterally out from the first side edge, and a second post extending laterally out from the second side edge, the first post and the second post being rotatably disposed within the receiving holes of the housing.

15. The dispenser of claim 14, wherein the first wall and the second wall are curved.

16. The dispenser of claim 15, wherein a portion of the first curved wall is disposed inside the housing and a portion of the first curved wall is disposed outside the housing.

17. The correction tape dispenser of claim 15, wherein the applicator tip extends through a circular opening in the housing, the applicator tip being rotatable within the circular opening.

* * * * *